United States Patent [19]

Murayama et al.

[11] 4,352,642

[45] Oct. 5, 1982

[54] HERMETIC MOTOR-COMPRESSOR

[75] Inventors: Akira Murayama; Fumio Harada; Kazutaka Suefuji, all of Shimizu, Japan

[73] Assignee: Hitachi, Ltd., Tokyo, Japan

[21] Appl. No.: 136,675

[22] Filed: Apr. 2, 1980

[30] Foreign Application Priority Data

Apr. 4, 1979 [JP] Japan ..... 54/43477[U]
Jul. 6, 1979 [JP] Japan ..... 54/92533[U]

[51] Int. Cl.[3] ..... F04B 21/00; F04B 39/00; F04B 39/04

[52] U.S. Cl. ..... 417/312; 417/363; 417/373; 417/902

[58] Field of Search ..... 417/363, 902, 373, 312, 417/542

[56] References Cited

U.S. PATENT DOCUMENTS 3,008,628 11/1961 Gerteis et al. ..... 230/58
3,486,687 12/1969 Ayling ..... 230/206
3,584,981 6/1971 Worster ..... 417/542
4,200,426 4/1980 Linnert ..... 417/363

FOREIGN PATENT DOCUMENTS 52-45716 4/1977 Japan ..... 417/312

*Primary Examiner*—Richard E. Gluck
*Assistant Examiner*—Peter M. Cuomo
*Attorney, Agent, or Firm*—Antonelli, Terry & Wands

[57] ABSTRACT

A hermetic motor-compressor for a refrigerating system. The hermetic motor-compressor has a motor component and a compressor component drivingly coupled to each other and disposed within a closed container. The refrigerant gas introduced from an evaporator of a refrigerating system through a return pipe is once released into the space within the closed container and then sucked by the compressor component so as to be compressed and discharged to the outside. A barrier is provided on the outer periphery of the motor and compressor components for preventing a main flow of the refrigerant gas introduced into the closed container through the return pipe from flowing into the circumference of high-temperature portions of the hermetic motor-compressor.

12 Claims, 8 Drawing Figures

HERMETIC MOTOR-COMPRESSOR

BACKGROUND OF THE INVENTION

The present invention relates to a refrigerating system and, more particularly, to a hermetic motor-compressor for a refrigerating system.

The refrigerating system has a closed refrigerant circuit comprising a refrigerant compressor, condenser, pressure reducer and an evaporator which are connected in series by means of pipes.

The compressed refrigerant gas discharged from the refrigerant compressor is cooled and liquefied in the condenser, and the liquefied refrigerant flows into the evaporator after a pressure reduction by the pressure reducer. The refrigerant of reduced pressure then absorbs heat from a fluid to be cooled, while passing through the evaporator, thereby to be evaporated and then returned to the refrigerant compressor completing one refrigerating cycle. The fluid to be cooled is cooled by the heat absorption performed in the evaporator, and is used for various purposes.

Hermetic motor-compressors now find widespread use as the refrigerant compressor. This type of compressor has an electric motor component and a compressor component disposed in a closed container and operatively connected to each other. The hermetic motor-compressor, however, has the following problems.

Since the compressor component is confined in the closed container and thermally insulated from the ambient air by the closed container, the compressor component reaches such a high temperature that it undesirably heat the ambient refrigerant gas within the closed container. In consequence, the refrigerant gas of a low temperature, which has been returned from the evaporator to the hermetic motor-compressor and uniformly dispersed in the closed container, is heated and the temperature of the refrigerant gas sucked into the compressor component through a suction pipe opening in the closed container is raised. As a result, the specific weight of the refrigerant gas is increased to decrease the flow rate by weight of the refrigerant gas, resulting in a reduced volumetric efficiency of the compressor.

In the refrigerating system, the reduction of the volumetric efficiency causes a drop of the refrigerating power per unit input.

The refrigerant gas dispersed in the closed container flows, particularly when the return pipe is connected to a point near the top of the closed container, downwardly along the outer walls of the electric motor component and the compressor component and, therefore, is heated by the hot outer wall of the compressor component. The reaction of the downward flow of refrigerant gas forcibly drives the heated refrigerant gas in the container upward and inconveniently scatters the lubricating oil from an oil reservoir defined at the bottom of the closed container. The lubricating oil scattered upward is sucked together with the refrigerant gas into the compressor component through a suction pipe standing up from the cylinder head to cause not only the reduction of the volumetric efficiency but also an oil hammering.

U.S. Pat. No. 3,008,628 to K. M. Gerteis et al discloses a hermetic motor-compressor which is arranged such that the lubricating oil in the crank chamber is discharged into an oil reservoir by using blow-by gas coming from the cylinder. In the motor-compressor disclosed in the Gerteis et al patent, the electric motor component and the compressor component are separated from each other, in a vertical direction, by a partition wall. The motor and compressor assembly, having a crankshaft and motor shaft integral therewith, is housed within a closed container through a flange provided at the top of a cylindrical member surrounding the compressor component, and an oil tank or reservoir is formed around the cylindrical member. The refrigerant gas returned into the closed container flows through a passage formed around the outer periphery of the motor component and through a gap between the stator and rotor of the motor component to effectively cool the motor component, before it is sucked into the cylinder through a space beneath the motor component and an opening formed in the partition plate. Thus, the refrigerant gas itself is heated, although the motor component is cooled effectively.

U.S. Pat. No. 3,486,687 to R. W. Ayling discloses a hermetic motor-compressor which is arranged such that liquid refrigerant flowing into the closed container is evaporated by the heat delivered by the hot compressor component to prevent the dilution of the oil by the liquid refrigerant. In the motor-compressor disclosed in the Ayling patent, the motor and compressor components are housed within a closed container with the motor component disposed above the compressor component. The compressor component is encased by an inner casing which is in contact with the parts adapted to be heated to a high temperature, e.g. head cover, discharge muffler and the like, thereby to constitute a heat exchanger for the hot compressor component. The liquid refrigerant returned into the closed container through a suction port formed in the latter, therefore, is made to drop into the inner casing and is evaporated because of heat-exchange thereof with the hot parts. The refrigerant gas is heated by the inner casing and the hot compressor component to a high temperature before it is sucked into the cylinder.

SUMMARY OF THE INVENTION

It is, therefore, an object of the invention to provide a hermetic motor-compressor in which the refrigerant gas, which is returned to the closed container and then sucked into the compressor cylinder, is prevented from being heated by the contact of the gas with the high temperature portions of the motor-compressor thereby to ensure a higher volumetric efficiency.

Another object of the invention is to provide a hermetic motor-compressor which is arranged to prevent the direct flow of the refrigerant gas returned into the space in the closed chamber toward an oil reservoir defined at the bottom of the space and to avoid the upward flow of the high-temperature ambient refrigerant gas around the compressor component and upward scattering of the lubricating oil from the oil reservoir.

Still another object of the invention is to provide a hermetic motor-compressor in which the undesirable foaming of lubricating oil is prevented to avoid breakdown of valve mechanisms attributable to an oil hammering.

To these ends, according to the invention, there is provided a hermetic motor-compressor comprising: a closed container; a compressor component disposed within the closed container and including a frame, a crankshaft vertically supported by the frame, a cylinder and head cover assembly, a piston slidably fitted in the cylinder and a connecting rod connecting the crankshaft and the piston to each other; an electric motor component disposed within the closed container above the frame and connected to the crankshaft; means for resiliently supporting the motor and compressor components on the closed container; an oil reservoir defined in the bottom of the closed container; a return pipe for refrigerant gas having one end thereof connected to the top of the closed container; a suction pipe having one end thereof connected to the cylinder and the other end opening to an upper portion of a space defined by the closed container; a discharge pipe having one end thereof connected to the cylinder and the other end passing through the wall of the closed container; deflecting means mounted on the outer periphery of the motor and compressor components for minimizing flow of refrigerant gas, introduced into the space within the closed container through the return pipe, into the circumference of a high temperature portions of the motor-compressor.

The refrigerant gas of the refrigerating system flows back from the evaporator into the closed container through the return pipe. The main part of this flow of low-temperature refrigerant gas tends to flow to make direct contact with the outer wall of the high-temperature portions of the compressor component. This main flow, however, is deflected by the deflecting means provided around the motor and compressor components and, therefore, is not in contact with the high-temperature portions. Further, since the direct flow of the refrigerant is toward the oil reservoir defined at the bottom of the space in the closed container, the undesirable upward flow of high-temperature ambient gas around the high-temperature portions of the compressor component does not take place and, accordingly, the heating of the refrigerant gas to be sucked is fairly avoided. Thus, the refrigerant gas is sucked into the compressor cylinder while being maintained at a sufficiently low temperature, thereby to increase the volumetric efficiency and, hence, the refrigerating power per unit input.

In addition, the undesirable sucking of the lubricating oil is prevented because the aforementioned upward scattering of the oil does not take place.

The means for deflecting flow of the refigerant gas, which is returned into the closed container, from the area around the high-temperature portions of the compressor component, may comprises a deflector or baffle extending from the outer periphery of the motor and compressor components to an area near the inner surface of the closed container. This arrangement offers the following advantages, in addition to the above-explained features. Namely, since there is only a small clearance between the inner surface of the closed container and the deflector, the abrupt pressure drop taking place at the start-up of the compressor component acts only gradually or gently on the area below the deflector. Therefore, the quick evaporation of the refrigerant in the oil, i.e. a foaming of the lubricating oil, is suppressed even when the refrigerant has been dissolved in the lubricating oil. Even in the event of a foaming, the foamed lubricating oil is prevented from reaching the suction port, because the barrier effectively checks the foam of oil to prevent a failure, such as brekdown of the valve mechanism, from occuring. Further, the noise caused by resonance is suppressed because the vertical propagation of sound waves in the closed container is restrained by the deflector. It is possible to thermally insulate the spaces above and below the deflector, by forming the latter with a heat insulating material such as plastics.

An arrangement including a heat insulating deflector extending over the entire partition wall separating motor and compressor components from each other effectively insuates thermally the ambient gas within a space below the motor component from the partition wall of high temperature.

BRIEF DESCRIPTION OF THE DRAWINGS

The invention will be described in detail hereinafter, by way of an example, with reference to the accompanying drawings in which.

DESCRIPTION OF THE PREFERRED EMBODIMENTS

Figure 1:
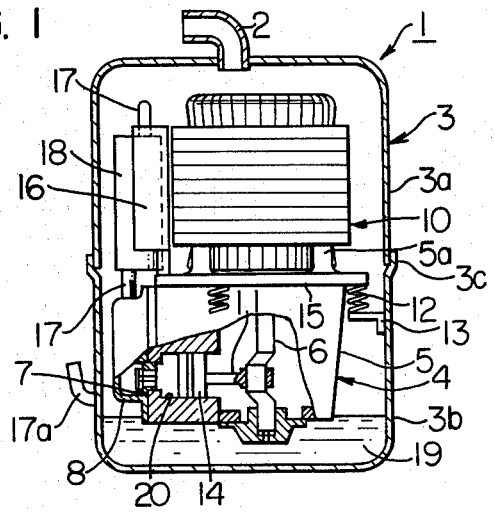
FIG. 1 is a vertical sectional view of a hermetic motor-compressor constructed in accordance with an embodiment of the invention.
Figure 2:
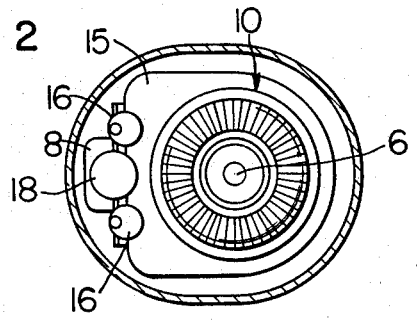
FIG. 2 is a plan view of the hermetic motor-compressor shown in FIG. 1 with its upper part sectioned.

FIGS. 1 and 2 in combination show a hermetic motor-compressor generally designated at a reference numeral 1, constructed in accordance with a first embodiment of the invention.

The hermetic motor-compressor 1 comprises a closed container 3 which includes an upper container section 13*a* and a lower container section 3*b* welded to the latter at an intermediate section 3*c*. A return pipe 2 is connected to the top wall section of the closed container 3 and is opened into the latter. The return pipe is connected to a pipe which in turn is connected to the outlet side of an evaporator (not shown) of a refrigerating system, and is adapted to introduce the refrigerant gas evaporated in the evaporator into the closed container 3. The motor-compressor 1 has an electric motor component 10 and a compressor component 4 drivingly connected thereto. The compressor component 4 has a crankshaft 6 vertically supported by a frame 5, a connecting rod 11, connected between the crankshaft 6 and a piston 14, and a cylinder receiving the piston 14. A cylinder head 7 and a head cover 8 are disposed on the end of the cylinder. The electric motor component 10 is fixed to columns 5*a* standing upward from the frame 5 by means of bolts and nuts (not shown) or the like, and is coupled to the crank shaft 6. The assembly comprising an upper motor component 10 and a lower compressor component 4 coupled to each other is resiliently supported through coiled springs 12 by brackets 13 attached to the inner surface of the closed container 1 and is housed within the latter. A substantially horseshoe shaped deflector or baffling plate 15 extends unitarily and outwardly from the upper portion of the outer periphery of the frame 5. The deflector 15 has an outer peripery which forms a suitable annular gap between itself and the inner surface of the closed container. The aforementioned coiled springs 12 are attached at their upper ends to the lower side of the deflector 15. A suction silencer 16 is vertically mounted on the portion of the frame above the end of the cylinder. The suction silencer 16 defines a suction gas passage having a suction opening in its upper end, and is connected to the cylinder through a suction valve mechanism (not shown) in the cylinder head 7. Also, a discharge pipe 17 is connected to the upper side of the head cover 8. The discharge pipe 17 is provided with a discharge silencer 18 and is bent and extends over a considerable length in a space between the motor and compressor components and the wall of the closed container 3. The end portion of the discharge pipe extends through the wall of the closed container. The bending or winding arrangement of the discharge pipe 17 permits absorption of the vibration of the motor and compressor components. An oil reservoir 19 is defined at the bottom of the closed container 3.

Hereinafter, a description will be given of the operation of the hermetic motor-compressor of the embodiment described above.

The refrigerant gas introduced through the return pipe 2 into the closed container 3 is distributed in the latter, and is sucked into the cylinder 20 of the compressor component 4 through the suction silencer 16. The gas compressed by the piston 14 reciprocating in the cylinder 20 is delivered to the discharge pipe 17 through the head cover 8 and is forwarded to the condenser (not shown) of a refrigerating system through the discharge silencer 18 and the end 17*a* of the discharge pipe. As has been described, the refrigerant gas flowing into the closed container 3 through the return pipe 2 is distributed in the closed container 3. The main gas flow trails downwardly along the outer surface of the motor component 10.

Since the deflector 15 of a suitable width extends from the outer periphery of the frame 5 in the joint portion of the compressor component 4 and the motor component 10, the above-mentioned gas flow flowing downwardly along the outer surface of the motor component 10 is deflected by the baffling plate or deflector 15 to flow toward the inner surface of the closed container along the upper surface of the deflector 15. The flow of gas is further deflected by the inner surface of the closed container so as to produce an upward flow component, so that the refrigerant gas of low temperature introduced into the closed container 3 is sucked into the cylinder through the suction passage of the suction silencer 16, without having a chance to contact with the surface of high-temperature portions such as frame 5 and head cover 8 of the compressor component 4.

Thus, due to the provision of the deflector 15, the downward flow of the refrigerant gas introduced into the closed container 3 is deflected by the deflector 15 and does not reach the high-temperature portions of the compressor component below the deflector. In consequence, the refrigerant gas is sucked into the cylinder 20 at a low temperature, without being heated by the high-temperature portions of the compressor component 4. Therefore, the undesirable increase in specific volume of the refrigerant gas sucked into the cylinder 20 and, hence, the reduction in flow rate by weight of the sucked gas are avoided to ensure a higher volumetric efficiency and, accordingly, a higher refrigerating power per unit input of the refrigerating system.

In the described embodiment, the discharge pipe 17 and the discharge silencer 18 are disposed above the deflector 15. This arrangement is quite ordinary from the view point of manufacture. Since the discharge pipe and the discharge silencer have a high temperature, a heating of the ambient gas and, hence, the heating of the gas to be sucked into the compressor component is inevitable. Such a heating, however, is practically negligible.

Figure 3:
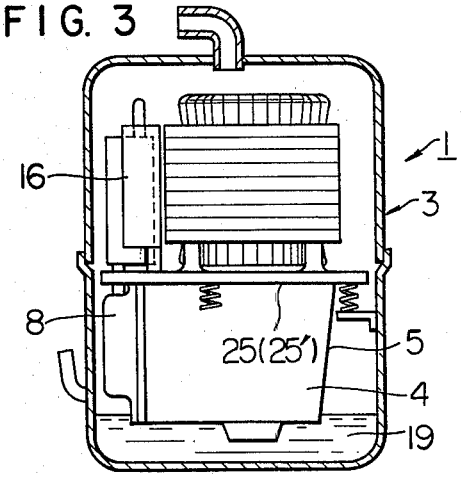
FIG. 3 is a vertical sectional view of a hermetic motor-compressor constructed in accordance with another embodiment of the invention.
Figure 4:
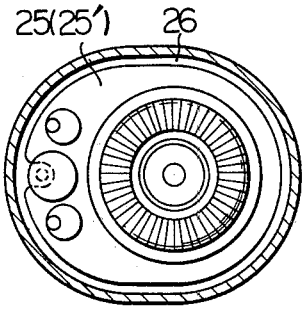
FIG. 4 is a plan view of the hermetic motor-compressor shown in FIG. 3 with its upper part sectioned.

FIGS. 3 and 4 in combination show a hermetic motor-compressor of another embodiment. The hermetic motor-compressor of this embodiment differs from those of other embodiments in that the deflector formed at the upper peripheral portion of the frame 5 extends substantially over the entire space between the inner surface of the closed container and the outer periphery of the compressor component 4.

More specifically, a baffling plate or barrier 25 is formed unitarily with the upper peripheral part of the frame 5 to project therefrom to an rear near the inner surface of the closed container 3. The deflector 25 projects to overlie the head cover 8 and extends substantially over the entire area between the inner surface of the closed container 3 and the outer periphery of the compressor component 4. The clearance 26 between the barrier 25 and the inner surface of the closed container 3 is much smaller than that of the preceding embodiment. Other parts are materially identical to those of the preceding embodiment and, therefore, the detailed description is omitted.

According to the embodiment in FIGS. 3 and 4, since the deflector 25 extends to an area near the inner surface of the closed container 1 to leave only a small clearance 26 therebetween, the effect of the invention for insulating the refrigerant gas, which is to be sucked into the compressor component, from the heat transmitted from the high-temperature portions of the compressor component is further enhanced. Also, the following effect is brought about by this embodiment. Namely, since the clearance 26 is very small, the abrupt pressure reduction at the time of start-up of the compressor acts only gradually or slowly on the space below the deflector 25, so that the so-called foaming of lubricating oil, which is caused by an abrupt evaporation of liquid refrigerant at the time of start-up, is fairly avoided even when the liquid refrigerant is dissolved in the lubricating oil in the oil reservoir 19 during suspension of operation. The deflector 25 prevents the foam of lubricating oil from coming into the space above the deflector 25, even when the foaming has taken place, so that the breakdown of valve mechanism due to an oil hammering is eliminated.

Further, the deflector 25 suppresses the vertical propagation of sound waves in the closed container 3, so that the noises attributable to the resonance or the like is diminished.

The deflector 25 may be formed separately from the frame 5. In such a case, the deflector 25' is formed as a substantially annular plate having an inner periphery slightly greater than the outer periphery of the frame 5 and an outer periphery large enough to reach the area near the inner surface of the closed container 1. From a view point of insulation of heat, the deflector is preferably made of a heat insulating material such as a plastic. The use of a plastic as the material of the deflector provides a flexibility which absorbs the interference of the barrier and the inner surface of the closed container 1 during operation, in addition to the heat insulating effect.

Figure 5:
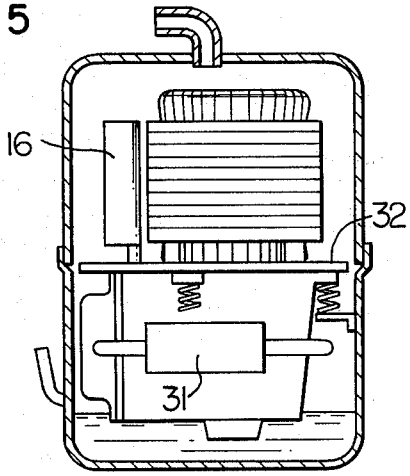
FIG. 5 is a vertical sectional view of a hermetic motor-compressor constructed in accordance with still another embodiment of the invention.
Figure 6:
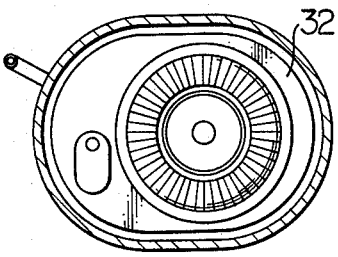
FIG. 6 is a plan view of the hermetic motor-compressor shown in FIG. 5 with its upper part sectioned.

FIGS. 5 and 6 show still another embodiment of the invention. The embodiment differs from the preceding embodiments in that a discharge silencer 31 is disposed below a baffling plate or deflector 32. In this embodiment, the barrier 32 may be formed integrally with the frame and may have a comparatively small width as in the embodiment shown in FIG. 1 or the barrier may have a width large enough to reach the area near the inner surface of the closed container as in the embodiment shown in FIG. 3. Alternatively, the deflector may be formed separately in an annular shape from a plastic. Other parts are not described here because they are materially identical to the corresponding parts of the preceding embodiments. Since the discharge silencer 31, constituting a part of the high-temperature portions, is disposed below the deflector 32, there are no high-temperature portions in the space above the deflector, so that the effect of insulation of the refrigerant gas from the heat is further enhanced.

Figure 7:
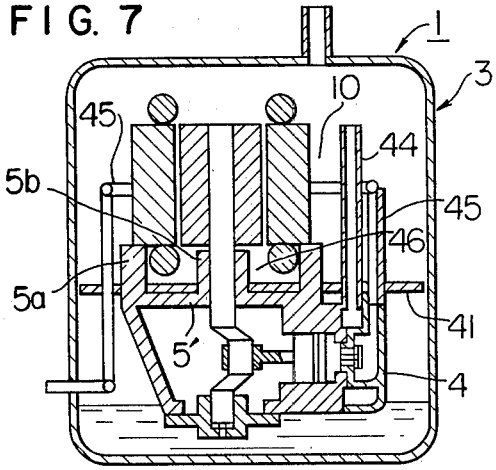
FIG. 7 is a vertical sectional view of a hermetic motor-compressor constructed in accordance with a further embodiment of the invention.
Figure 8:
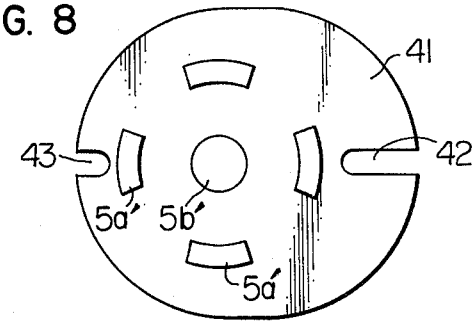
FIG. 8 is a plan view of the hermetic motor-compressor shown in FIG. 7 with its upper part sectioned.

FIGS. 7 and 8 show a further embodiment of the invention. While in the preceding embodiments the deflector is provided only around the motor and compressor components, the deflector of this embodiment is provided also on the upper part of the partition wall which separates the motor component and the compressor component from each other, thereby to prevent the overheating of the ambient gas in a lower chamber 46 below the motor component. Namely, the baffling plate or deflector 41 extends to overlie also the upper surface of the partition plate 5' of the frame separating the motor component 10 and the compressor component 4 from each other.

The deflector 41 is made of a heat insulating material such as a plastic and has an outer configuration which extends to the area near the inner surface of the container 3 as shown in FIG. 8. Notches 42, 43 and apertures **5*a'*, 5*b'* are formed in the deflector 41 as illustrated. Apertures 5*a'* are formed to receive a plurality of columnar parts 5*a* projecting upward from the outer peripheral portion of the partition wall 5' for fixing the motor component, while the aperture 5*b'* formed at the center of the deflector 41 is adapted to receive a main bearing 5*b* formed at the center of the partition wall 5'. The notch 42 receives the suction and discharge pipes 44, 45, while the notch 43 receives only the discharge pipe 45**.

In assembling of the motor component, the deflector 41 is placed such that the columnar parts **5*a* and the main bearing 5*b*** are received in respective apertures. Other parts are not described, because they are materially identical to corresponding parts of the preceding embodiments.

The partition wall 5' is heated up to a high temperature by the heat delivered from the compressor component 4, and the partition wall 5' occupies a considerably large portion of the cross-sectional area of the space inside the closed container 1. However, since the deflector 41 made of a heat insulating material is disposed also over the partition wall 5', the ambient refrigerant gas in the lower chamber 46 below the motor component 10 is not heated by the partition wall 5'. Therefore, the ambient refrigerant gas does not heat the refrigerant gas to be sucked when these refrigerant gases are mixed with each other, so that the effect of the invention to prevent the heating of the refrigerant gas to be sucked into the compressor component is further ensured.

The adverse effect of heat transfer from the discharge pipe is completely avoided if the suction passage formed by the suction silencer and the suction pipe 44 are formed of a heat insulating material such as a plastic, so that the effect of the invention to prevent the heating of the suction refrigerant gas is further enhanced.

What is claimed is:

1. In a hermetic motor-compressor comprising:

a closed container;

an electric motor component disposed within said closed container;

a compressor component disposed within said closed container and below said electric motor component and including a frame having mounted thereon said electric motor component, a crankshaft vertically supported by said frame and connected to said electric motor component, a cylinder and head cover assembly, a piston slidably fitted in said cylinder and a connecting rod connecting said crankshaft and said piston to each other;

means for resiliently supporting said motor and compressor components on said closed container;

an oil reservoir defined at the bottom of said closed container;

a return pipe for refrigerant gas having one end thereof connected to the top of said closed container;

a suction pipe having one end thereof connected to said cylinder and the outer end opening in an upper portion of a space defined by said closed container for directly introducing the refrigerant gas into said cylinder through said suction pipe only; and a discharge pipe having one end thereof connected to said cylinder and the other end passing through the wall of said closed container, the improvement which comprises:

deflecting means extending radially outwardly from the top of said frame toward the inner periphery of said closed container with a peripheral gap defined between said deflecting means and the inner periphery of said closed container, for deflecting a flow of refrigerant gas introduced into the space within said closed container through said return pipe in a manner so as to minimize refrigerant gas flow into a circumference of high temperature portions of said compressor component below said deflecting means.

2. A hermetic motor-compressor as claimed in claim 1, wherein said deflecting means includes a deflector formed on said frame in integral relation therewith.

3. A hermetic motor-compressor as claimed in claim 2, wherein said deflector extends along the entire periphery of said frame.

4. A hermetic motor-compressor as claimed in claim 2, wherein said deflector extends to a position above said head cover.

5. A hermetic motor-compressor as claimed in claim 2, wherein said deflector extends to a peripheral area near the inner surface of said closed container.

6. A hermetic motor-compressor as claimed in claim 1, wherein said deflecting means includes a deflector made of a heat insulating material, said deflector including a substantially annular plate having an outer periphery extending to an area near the inner surface of said closed container and an inner periphery of a shape substantially complementary to the outer periphery of said frame, said annular plate being disposed at the outer periphery of the top of said frame.

7. A hermetic motor-compressor as claimed in claim 1, wherein said deflecting means includes a deflector made of a heat insulating material, said barrier having an outer periphery extending to the area near the inner surface of said closed container, said frame having columnar parts for mounting said motor component on said compressor component and a main bearing for said crank shaft, said columnar parts and said main bearing extending through said deflector, said deflector being disposed on a partition wall separating said motor component and said compressor component from each other.

8. A hermetic motor-compressor as claimed in claim 1, further comprising a discharge silencer mounted on a portion of said discharge pipe below said deflecting means.

9. A hermetic motor-compressor as claimed in claim 1, wherein said suction pipe is formed from a heat insulating material, said hermetic motor-compressor further including a suction silencer made of a heat insulating material and mounted in said suction pipe.

10. A hermetic motor-compressor comprising:

a closed container;

an electric motor component disposed within said closed container;

a compressor component disposed within said closed container below said motor component, said compressor having a frame upon which said motor component is mounted;

mounting means for supporting said motor and compressor components within said closed container;

an oil reservoir defined between the compressor and a bottom portion of the closed container;

a return pipe for refrigerant gas having one end communicating into an upper end of the closed container;

a suction pipe connected at one end to said compressor and opening at an opposite, inlet end into a space defined within an upper end of the closed container for introducing the refrigerant gas directly into said compressor; and deflecting means disposed on said frame between said compressor component and motor component below said inlet end of the suction pipe and projecting radially outwardly from the top of said frame, for deflecting refrigerant gas flowing downwardly along an outer surface of the motor component radially outwardly to an inner wall of the closed container and away from said compressor component, so as to minimize contact between said refrigerant gas and exterior parts of said compressor located therebelow.

11. A hermetic motor-compressor according to claim 10, wherein said deflector means comprises an annular plate of heat insulating material mounted upon the top of said compressor frame, said plate extending into close proximity with an interior wall of said closed container.

12. A hermetic motor-compressor according to claim 11, wherein said annular plate is formed of a plastic.

* * * * *